US007156021B2

(12) United States Patent
Förch et al.

(10) Patent No.: US 7,156,021 B2
(45) Date of Patent: Jan. 2, 2007

(54) MACHINE FOR PROCESSING SHEETS OF PRINTING MATERIAL

(75) Inventors: Peter Förch, Neustadt (DE); Alexander Klee, Wendelsheim (DE); Markus Möhringer, Weinheim (DE); Stefan Mutschall, Östringen (DE); Paul Nicola, Heidelberg (DE); Marius Stelter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/068,297

(22) Filed: Feb. 28, 2005

(65) Prior Publication Data

US 2005/0188869 A1 Sep. 1, 2005

(30) Foreign Application Priority Data

Feb. 27, 2004 (DE) ..... 10 2004 009 703

(51) Int. Cl.
*B41F 1/30* (2006.01)

(52) U.S. Cl. ..... 101/408; 101/407.1; 101/409; 101/246; 271/275; 271/277

(58) Field of Classification Search ..... 101/229–232, 101/409; 271/69, 275
See application file for complete search history.

(56) References Cited

U.S. PATENT DOCUMENTS

| | | | | |
|---|---|---|---|---|
| 3,442,506 | A | 5/1969 | Pasquinelli | |
| 4,043,548 | A | 8/1977 | Pollich | |
| 4,242,959 | A | 1/1981 | Jeschke et al. | |
| 5,480,138 | A | 1/1996 | Haupenthal et al. | |
| 6,286,425 | B1 | 9/2001 | Leib et al. | |
| 6,308,620 | B1 | 10/2001 | Wadlinger et al. | |
| 6,578,846 | B1 | 6/2003 | Maul et al. | |
| 6,684,774 | B1 | 2/2004 | Wadlinger et al. | |
| 2002/0135123 | A1 | 9/2002 | Maul et al. | |
| 2003/0205153 | A1 | 11/2003 | Wadlinger et al. | |
| 2004/0135312 | A1 * | 7/2004 | Becker et al. | 271/275 |
| 2004/0255802 | A1 * | 12/2004 | Conzelmann et al. | 101/230 |

FOREIGN PATENT DOCUMENTS

| | | | |
|---|---|---|---|
| CH | 495 218 | | 10/1970 |
| DE | 43 15 513 | A1 | 11/1994 |
| DE | 198 26 891 | A1 | 12/1999 |
| DE | 199 12 709 | A1 | 10/2000 |
| DE | 100 14 417 | A1 | 9/2001 |
| EP | 0089080 | * | 9/1993 |
| EP | 1010526 | * | 6/2000 |

* cited by examiner

*Primary Examiner*—Daniel J. Colilla
*Assistant Examiner*—Marissa Ferguson-Samreth
(74) *Attorney, Agent, or Firm*—Laurence A. Greenberg; Werner H. Stemer; Ralph E. Locher

(57) ABSTRACT

A machine for processing sheets of printing material has a cylinder for transporting the sheets and sheet supports which are mounted such that they can be rotated about a sheet support axis of rotation and in each case contain supporting segments for pressing the sheets onto the cylinder. The supporting segments are mounted such that they can be pivoted as desired into an active position and into a passive position about pivot axes that are skewed relative to the sheet support axis of rotation or about rotary joints determining the pivot axes.

12 Claims, 13 Drawing Sheets

MACHINE FOR PROCESSING SHEETS OF PRINTING MATERIAL

BACKGROUND OF THE INVENTION

1. Field of the Invention

The present invention relates to a machine for processing sheets of printing material. The machine has a cylinder for transporting the sheets and sheet supports that are mounted such that they can be rotated about a sheet support axis of rotation and in each case contain supporting segments for pressing the sheets onto the cylinder.

Sheet-fed presses can have a sheet deliverer which, in the transport direction, contains leading gripper bars for firmly holding leading sheet ends of the sheets to be delivered, and trailing gripper bars for simultaneously firmly holding trailing sheet ends of the sheets. In such a deliverer, the set of leading gripper bars can be fixed to one pair of chains and the set of trailing gripper bars can be fixed to another pair of chains. Together with the pairs of chains, the leading gripper bars and the trailing gripper bars revolve around a delivery drum, which is equipped with the aforesaid sheet supports. The sheet supports are used to press the respective sheet against an impression cylinder adjacent to the delivery drum when the respective leading gripper bar has already gripped the leading sheet and the trailing gripper bars cooperating with the leading gripper bar have not yet gripped the trailing sheet end. The action of pressing the sheet against the impression cylinder, carried out by the sheet supports, is necessary in order that the aforesaid trailing gripper bar can grip the trailing sheet securely. Each of the leading gripper bars runs ahead at a specific distance relative to the trailing gripper bar associated with the aforesaid leading gripper bar. The distance depends on the length of the sheets, which can change from print job to print job. A change in the sheet length requires a correction of the aforesaid distance within the context of what is known as changing the format of the deliverer. During the format change, the leading gripper bar is set to a longer or shorter distance relative to the trailing gripper bar associated with it, by the pair of chains carrying the leading gripper bar being displaced relative to the pair of chains carrying the trailing gripper bar. Since the sheet supports are temporarily located between these two gripper bars during the circulation of the mutually associated leading gripper bars and trailing gripper bars, adaptation of the effective circumferential length of the sheet supports to the changed distance between the gripper bars is necessary within the context of the format change. For instance, the sheet supports have to be shortened if, during the format change, the leading gripper bar has to be displaced toward the trailing gripper bar, in order that the sheet supports do not hamper the displacement of the leading gripper bars.

Published, Non-Prosecuted German Patent Application DE 100 14 417 A1, corresponding to U.S. Pat. No. 6,578,846 and U.S. patent Disclosure 2002/0135123 (therein, see in particular column 9, line 15 to column 10 line 11), in which a machine corresponding to the generic type mentioned at the beginning is described, for this purpose, it is proposed to divide the respective sheet support into a leading sheet support section and a trailing sheet support section. In order to lengthen or shorten the respective sheet support, one of its sheet support sections is displaced in the circumferential direction relative to the other. The sheet support sections form the supporting segments mentioned at the beginning. According to one embodiment (see DE 100 14 417 A1, FIG. 2A), the two sheet support sections are disposed beside each other in such a way that the common track width of the sheet support sections or of their running strips is comparatively large. In this case, it is disadvantageous that the great track width requires a correspondingly great width of the print-free side edge of the sheet, on which the running strips roll. The great width of the print-free sheet side edge results in a restriction of the sheet area available for the printed image, and an increased sheet trim waste volume. In the other embodiments (see DE 100 14 417 A1, FIGS. 2B and 2C), in which the sheet support sections intermesh with one another in some regions and are covered by a carrier belt carrying comparatively narrow-track running strips, these problems are solved but only at the expense of other problems. In those circumferential regions in which the sheet support sections are not interengaged, the carrier belt is carried on the rear side by only one of the sheet support sections in each case and it therefore no longer has sufficient backing and stability. Damage and premature wear of the carrier belt is to be expected.

SUMMARY OF THE INVENTION

It is accordingly an object of the invention to provide a machine for processing sheets of printing material that overcomes the above-mentioned disadvantages of the prior art devices of this general type, whose sheet supports permit a comparatively small width of print-free corridors with which they make contact and have a long service life.

With the foregoing and other objects in view there is provided, in accordance with the invention, a machine for processing sheets of printing material. The machine has a cylinder for transporting the sheets, and sheet supports rotatably mounted about a sheet support axis of rotation and in each case have supporting segments for pressing the sheets onto the cylinder. The supporting segments are mounted such that they can be pivoted as desired into an active position and into a passive position about pivot axes. The pivot axes being skewed relative to the sheet support axis of rotation.

The machine according to the invention for processing sheets of printing material has a cylinder for transporting the sheets and sheet supports which are mounted such that they can be rotated about a sheet support axis of rotation and in each case contain supporting segments for pressing the sheets onto the cylinder. The supporting segments are mounted such that they can be pivoted as desired into an active position and into a passive position about pivot axes that are skewed relative to the sheet support axis of rotation.

The skewed pivot axes make it possible for the supporting elements in the active position to be lined up on one and the same line of alignment, which runs in a curved shape like a circular arc about the sheet support axis of rotation. On account of the configuration of the supporting segments aligned with one another in the active position, their track width or rolling line width and the consequent width of the print-free corridor of the sheet on which the supporting segments roll can be kept comparatively narrow. A further advantage is to be seen in the fact that the supporting segments can have segment heads for carrying pressure pads functioning as running strips. The segment heads are substantially more stable than the carrier belt used for carrying the running strip according to the prior art (Published, Non-prosecuted German Patent Application DE 100 14 417 A1 corresponding to U.S. Pat. No. 6,578,846 and U.S. patent Publication 2002/0135123). The service life of the segment heads is virtually unlimited, and the service life of the pressure pads is comparatively high.

In a development that is advantageous with regard to the variability of the sheet format and the fabrication of identical parts, the segment heads of the supporting segments form an overlapping formation in the passive position. The overlapping formation permits all of the supporting segments of the sheet supports that are to be displaced into the passive position to be pivoted toward one and the same side of the sheet support, namely toward the side of the sheet support facing away from the chain wheel closest to the sheet support. Thus, since no supporting segment has to be pivoted toward the aforesaid chain wheel and no supporting segment is located between the sheet support and the nearest chain wheel when in the passive position, the sheet support can be displaced along the sheet support axes of rotation very close to the chain wheel if a great sheet width of the sheets to be processed requires such a format change of the sheet supports. If the overlapping formation were not present, the sheet supporting segments would have to be pivoted alternately toward one and the other side of the sheet supports into the passive position, so that thereafter some of the supporting segments would be located between the sheet support and the chain wheel and would hamper the setting of the format of the sheet supports very close to the chain wheel. A further advantage of the overlapping formation is to be seen in the fact that it makes it possible to dispose the skewed pivot axes of all the supporting segments at the same radial spacing relative to the sheet support axis of rotation. The skewed pivot axes accordingly lie on one and the same circular arc, whose center of curvature is the sheet support axis of rotation. Accordingly, the sheet supports can be fabricated as identical parts that are no different from one another with respect to the segment length to be measured between the segment head and the pivot axis.

In a development which is advantageous with regard to automating the displacement of the supporting segments into the active position and into the passive position, the supporting segments in each case have a first stop and a second stop and the stops, preferably formed as cams. The stops are disposed to be offset relative to each other in such a way that a control lever that can be pivoted relative to the supporting segments strikes the first stop in order to fold the respective supporting segment in and strikes the second stop in order to fold the supporting segment out. The displacement of the respective supporting segment into the active position is therefore effected by the same actuating element as the displacement of the supporting segment into the passive position, namely by the control lever. In addition, only a single drive is necessary for the two folding movements of the supporting segment.

According to developments which are advantageous with respect to a compact configuration of the stops, the supporting segments belong to bistable tilting spring mechanisms, of which each has an indifferent dead position. The tilting spring mechanisms in each case contain a spring with a spring force characteristic which, in the indifferent dead position, runs through the respective skewed pivot axis. The lengths of the stops and the lengths of the cam tracks formed on the stops can be kept short, since the stops are needed only for the displacement of the supporting segments preceding the dead position, and the springs of the tilting spring mechanisms effect the displacement of the supporting segments following the dead position.

In a development which is advantageous with regard to the delivery of the sheets onto a sheet stack which is carried out without fluttering of the sheets and, accordingly, without smearing, the machine has a deliverer which contains leading gripper bars for firmly holding leading sheet ends of the sheets and trailing gripper bars for simultaneously firmly holding trailing sheet ends of the sheets.

In a development that is advantageous with regard to functionally reliable gripping of the trailing sheet ends by the trailing gripper bars, the sheet supports are constituent parts of a delivery drum belonging to the deliverer used for delivering the sheets. The delivery drum presses the respective sheet against the circumferential surface of the cylinder with the sheet supports or their activated supporting segments, so that the trailing gripper bars can pick up the trailing sheet end from the cylinder without disruption with support from a sucker bar disposed on the delivery drum.

In developments which are advantageous with regard to high operating reliability, the supporting segments are assigned locking catches for locking the supporting segments in the passive position. The locking catches are lined up in a row such that a lever arm that can be pivoted relative to the locking catches, in the course of its pivoting movement, strikes the locking catches one after another in order to actuate them. The locking catches prevent displacement of the supporting segments into the active position, resulting from the operator inadvertently striking these supporting segments in the passive position. Such inadvertent erection of the supporting segments could otherwise result in a collision between one of the leading gripper bars and inadvertently erected supporting segments, and machine damage resulting from this.

According to developments which are advantageous with regard to a further increase in the service life of the pressure pads with which the supporting segments are fitted, the supporting segments are assigned a throwing-on and throwing-off device for pivoting the supporting segments respectively in one pivoting direction and, in the process, into a thrown-off position. The active position is arranged before the passive position in the pivoting direction and the thrown-off position is arranged after, and the throwing-on and throwing-off device contains a control ring which can be rotated relative to the supporting segments and is mounted coaxially with the sheet support axis of rotation. The pressure pads are preferably composed of a resilient and comparatively soft plastic, whose resistance to wear caused by abrasion (the eraser effect) is unavoidably comparatively low. The cylinder against which the sheet supports press the sheet is preferably an impression cylinder, whose circumferential surface is provided with a rough anti-smear surface structure. During printing operation, the sheet to be pressed on is located between the pressure pads and the anti-smear surface structure, so that the latter cannot cause any kind of abrasion on the pressure pads during printing operation. When the machine is idling without sheet transport, there is no sheet between the anti-smear surface structure and the pressure pads, so that the latter would roll directly on the anti-smear surface structure in this case and would be subjected to severe abrasion by the latter if the pressure pads were not thrown off the impression cylinder and its anti-smear surface structure by the throwing-on and throwing-off device. By use of the control ring, a synchronous displacement of all the activated supporting segments into the thrown-off position, which has to be carried out quickly in the event of a printing interruption which occurs suddenly, can advantageously be carried out Other features which are considered as characteristic for the invention are set forth in the appended claims.

Although the invention is illustrated and described herein as embodied in a machine for processing sheets of printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
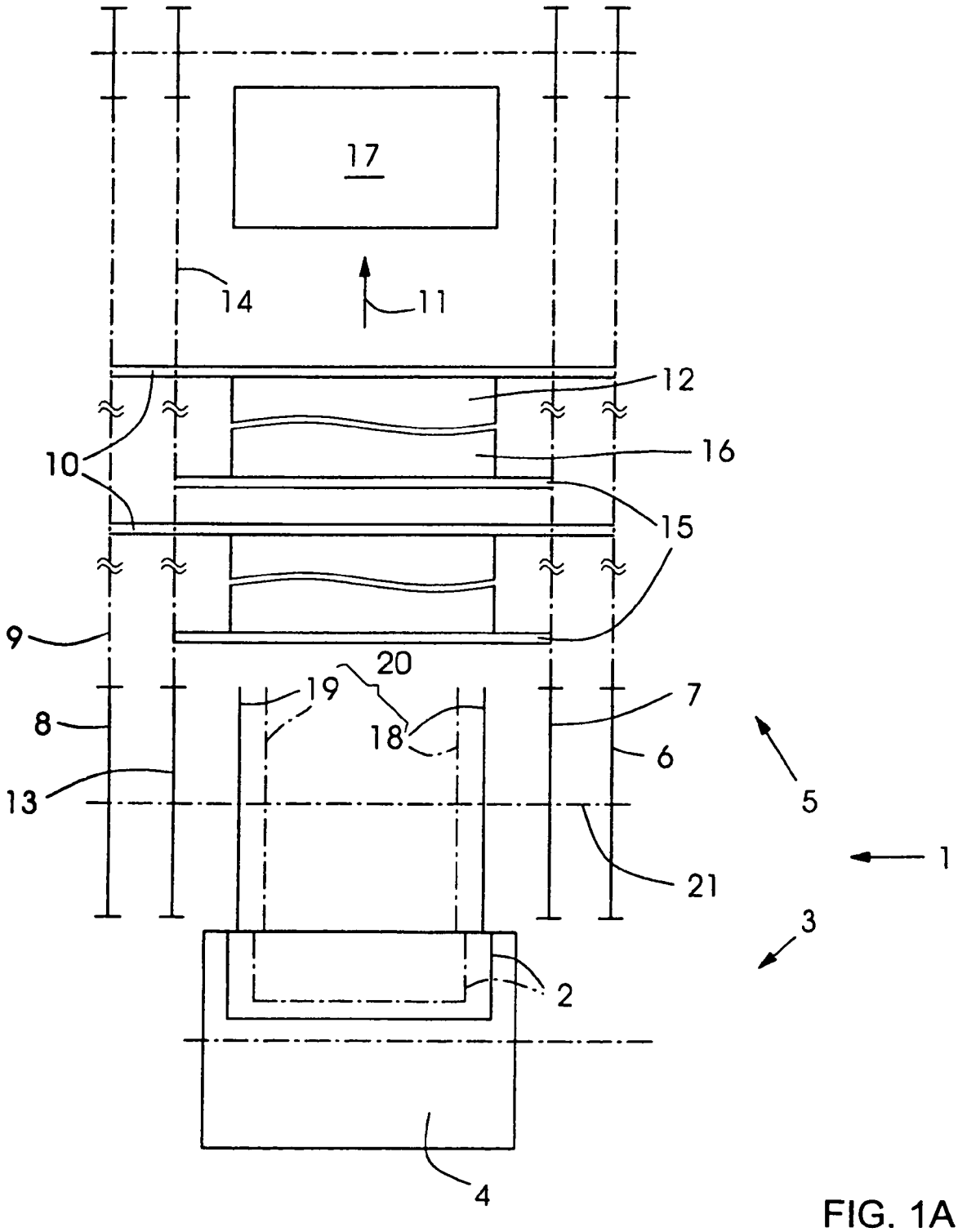
FIG. 1A is a diagrammatic, plan view of a press having a sheet deliverer according to the invention.

Referring now to the figures of the drawing in detail and first, particularly, to FIG. 1A thereof, there is shown schematically and in plan view, a machine 1 for processing sheets 2 of printing material. The machine 1 is a sheet-fed press and, for offset lithographic printing, and contains a printing unit 3 with a cylinder 4 and further contains a deliverer 5 with a first chain conveyor 6 and a second chain conveyor 7. The cylinder is an impression cylinder 4.

The first chain conveyor 6 contains a chain wheel 8 on the drive side and operating side in each case and an endless chain 9 running around the chain wheels. The endless chains 9 of the first chain conveyor 6 carry between them a gripper bar 10 leading in a transport direction 11 for holding leading sheet ends 12 of the sheets 2. The second chain conveyor 7 likewise contains a chain wheel 13 on each of the two machine sides and an endless chain 14 running around the chain wheel 13. The endless chains 14 of the second chain conveyor 7 carry between them trailing gripper bars 15 for holding sheet ends 16 trailing in the transport direction 11. Each of the trailing gripper bars 15, together with one of the leading gripper bars in each case, forms a pair of gripper bars which holds the respective sheet 2 firmly at both ends during its transport to a delivery stack 17.

A sheet support 18 placed on the drive side and a sheet support 19 placed on the operating side are structurally identical to each other in a mirror-symmetrical manner and are used to press the respective sheets 2 against the circumferential surface of the impression cylinder 4. The sheet supports 18, 19 are constituent parts of a drum 20 of skeleton construction, namely a delivery drum 20, belonging to the deliverer 5, and can be transposed continuously along the geometric sheet support axis of rotation 21 from a format setting for a maximum sheet width of the sheets 2, shown by a solid line in FIG. 1A, into a format setting for a minimum sheet width, indicated by a phantom line in FIG. 1A, and also into intermediate positions for medium sheet widths, located between these two extreme positions. In each format setting, the drive-side sheet support 18 is aligned with a print-free side edge, and the operating-side sheet support 19 is aligned with the other print-free side edge of the respective sheet 2. The sheet supports 18, 19 are mounted such that they can be displaced axially by motor between the chain wheels 8, 9 disposed on the drive side and belonging to the chain conveyors 6, 7 and their operating-side chain wheels. The drive (motor, gearbox) required for the optional axial displacement of the sheet supports 18, 19 toward each other or away from each other is not illustrated in the drawing for reasons of improved clarity.

The delivery drum 20 is a gripperless supporting drum, that is to say it does not contain a gripper system for clamping the sheets 2.

Figure 1B:
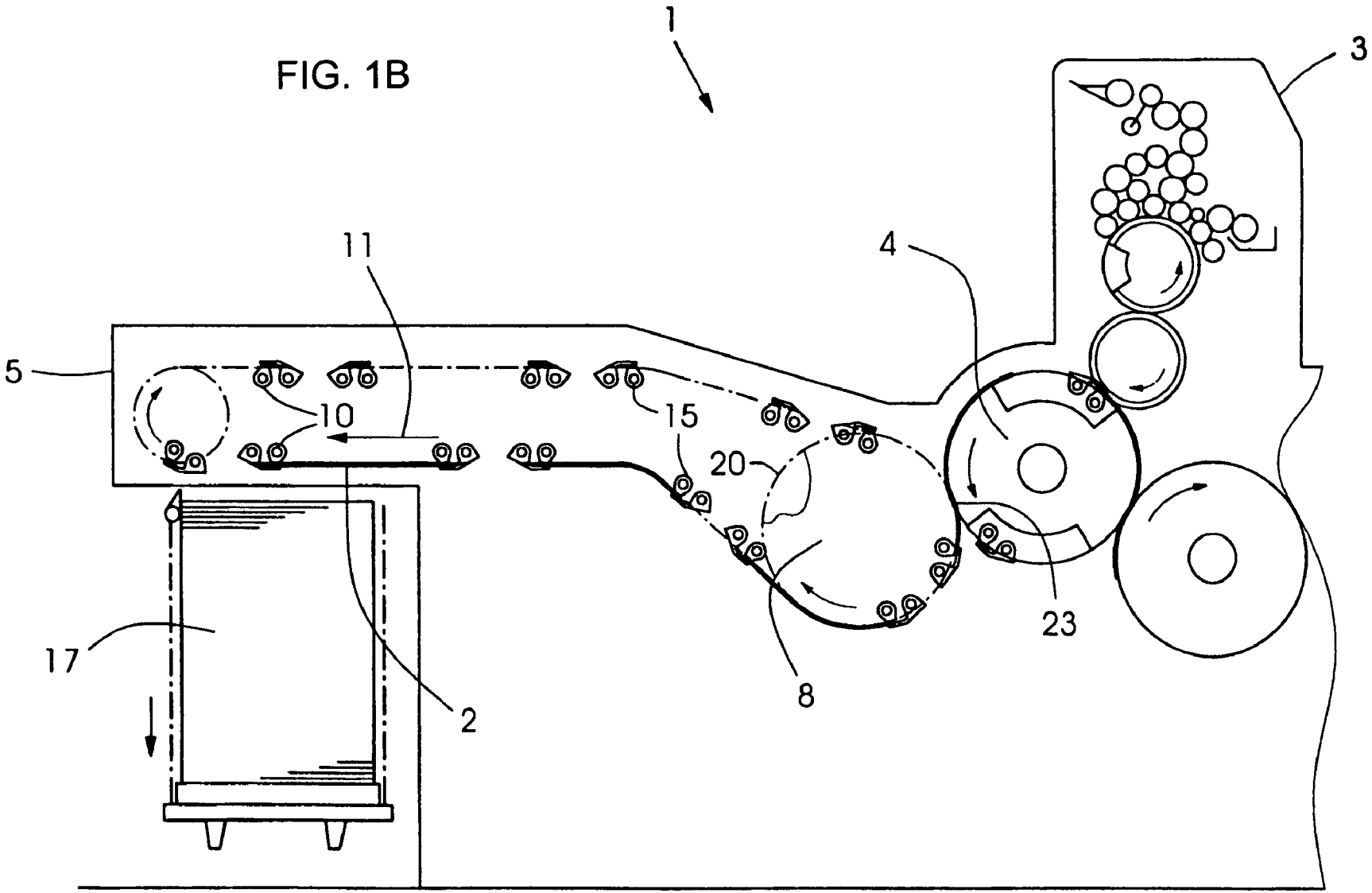
FIG. 1B is a side-elevational view of the press.

In FIG. 1B, the machine 1 is illustrated in side view and less schematically than in FIG. 1A.

Because of the structural identity, the explanations given in the following description with reference to the drive-side sheet support 18 also apply to the operating-side sheet support 19. In addition, the following description of one half of the drive-side sheet support 18 also applies to its diametrically opposite other half.

Figure 2A:
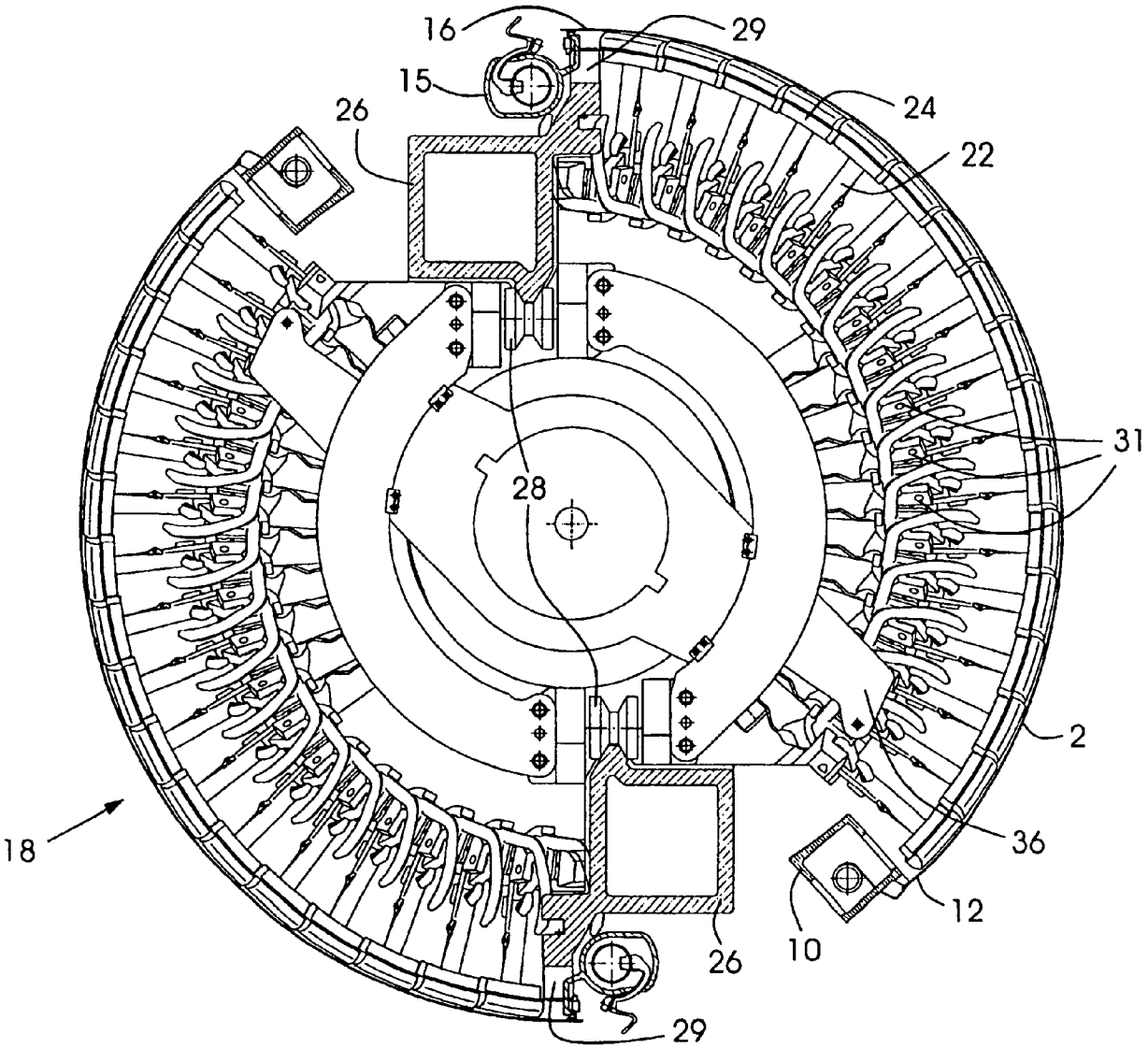
FIGS. 2A and 2B are perspective views showing various format settings of a sheet support of a delivery drum of the sheet deliverer.

FIG. 2A shows a format setting of the machine 1 provided for a maximum sheet length of the sheets 2. Here, the leading gripper bar 10 is set to a large distance, corresponding to the sheet length, relative to the trailing gripper bar 15 of the respective pair of gripper bars. This setting of the leading gripper bar 10 is carried out by rotating the chain wheel 8 of the first chain conveyor 6 relative to the chain wheel 13 of the second chain conveyor 7. The rotation of the wheels results in a phase shift of the endless chain 9 to which the leading gripper bar is fixed, relative to the endless chain 14 to which the trailing gripper bar 15 is fixed, corresponding to the format difference to be corrected. The sheet support 8 contains substantially T-shaped supporting segments 22, which press the respective sheet 2 onto the impression cylinder 4 at a common tangential point 23 (see FIG. 1B) of the delivery drum 20 and the impression cylinder 4. Segment heads 24 of the supporting segments 22 form a circumferential row extending substantially from the leading gripper bar 10 as far as the trailing gripper bar 15. In the maximum format setting, all the supporting segments 22 are erected, so that they project into the space between the two gripper bars 10, 15.

Figure 2B:
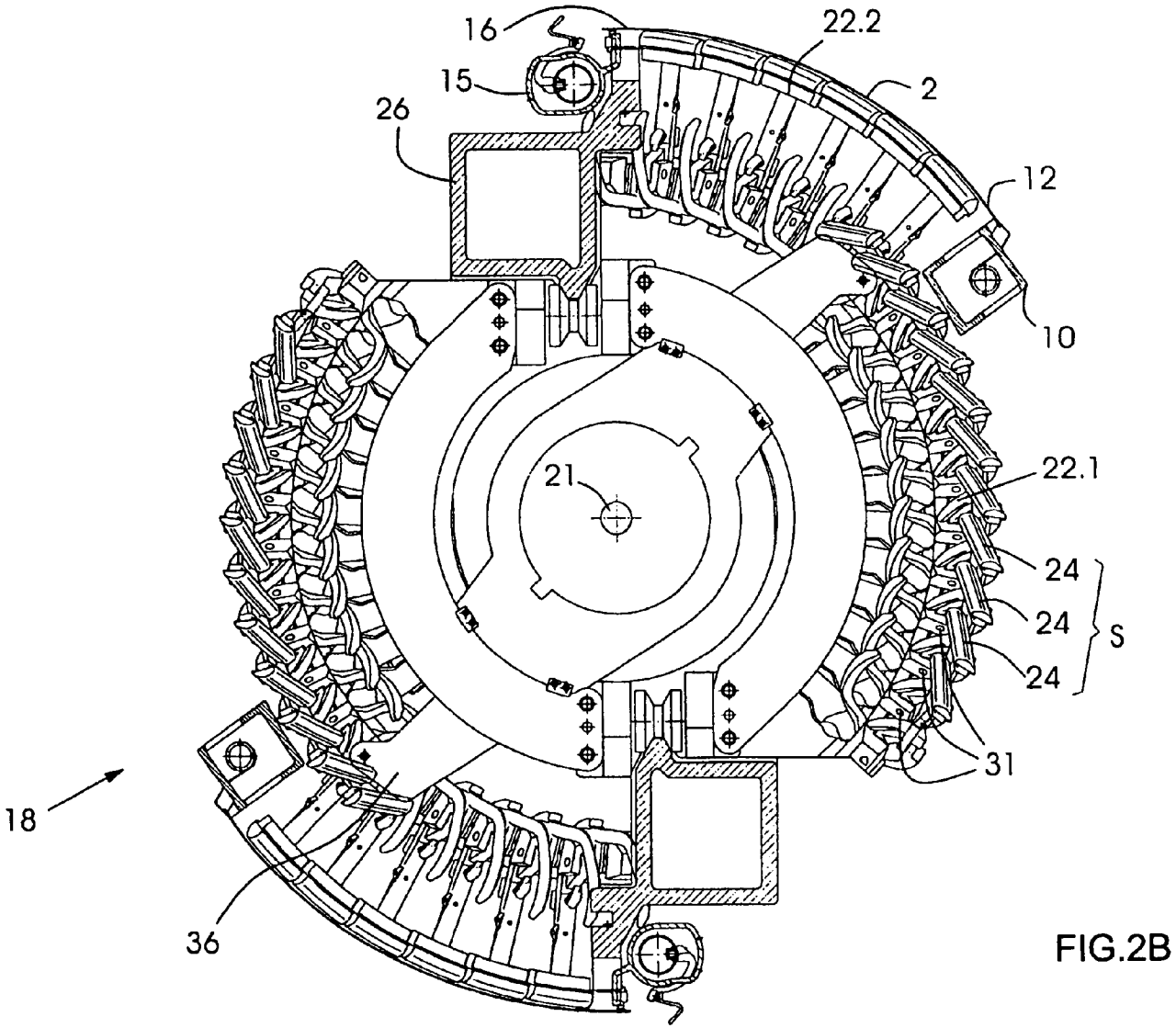
Figure 3:
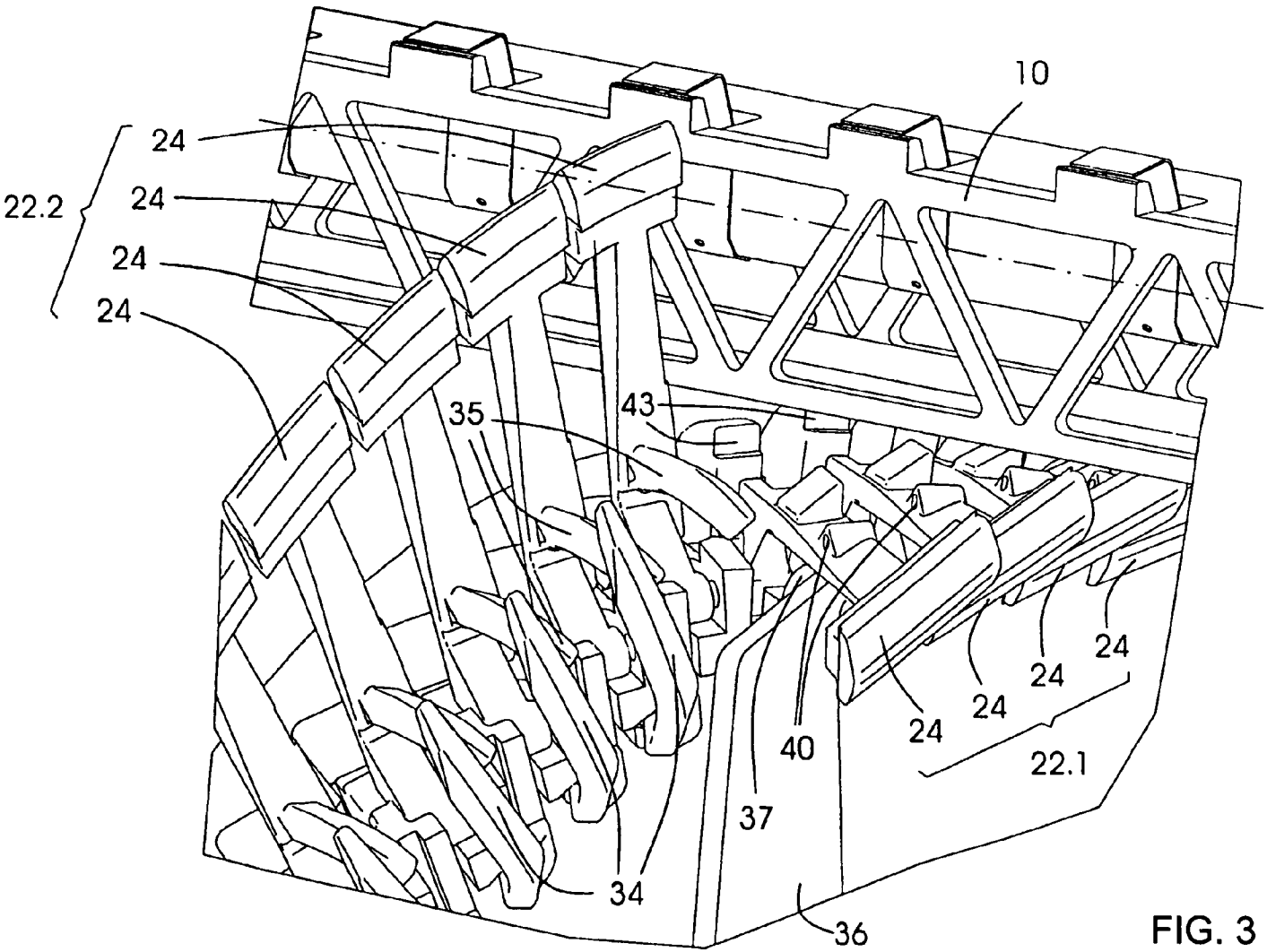
FIG. 3 is a detail, perspective view of the sheet support and a leading gripper bar of the sheet deliverer.

FIG. 2B shows a format setting for a minimum sheet length. Here, the distance between the two gripper bars 10, 15 has been reduced by about one half as compared with the format setting shown in FIG. 2A by a corresponding circulation angle displacement of the first chain conveyor 6 relative to the second chain conveyor 7. As a result of this format change, the leading gripper bar 10 has moved into the region of the circumferential row of supporting segments 22. This requires some of the supporting elements 22 to be folded into a proximal passive position 22.1 which, with respect to the delivery drum 20, is radially further in and pulled back from the first chain conveyor 6. Folding in the supporting segments 22 creates movement space for the gripper bar 10 running in the transverse direction parallel to the sheet support axis of rotation 21 and extending beyond the sheet support 18 and the supporting segments 22 of the latter. If the folded-in supporting segments 22 are in the passive position 22.1, the leading gripper bar 10 can be displaced over the folded-in supporting segments 22 and, unhindered by the latter, as far as the remaining supporting segments 22 which have been left folded out in a distal active position 22.2. The supporting elements 22 that have remained in the active position 22.2 are still erected, and unchanged with respect to FIG. 2A, in such a way that the segment heads 24 are aligned and adjoin one another virtually end to end with a small gap width. In this case, the segment heads 24 are aligned so as not to overlap and the segment heads 24 together form a rolling surface which is concentric with the chain wheels 8, 13 and which is interrupted only by the very narrow gaps between the supporting segments 22. By contrast, the supporting segments 22 displaced into the passive position 22.1 are aligned in such a way that their segment heads 24 overlap one another in an overlapping formation S. The segment heads 24 of the folded-in supporting segments 22 in each case partly cover the segment heads of the respectively adjacent supporting segments 22, if a viewing direction parallel to the sheet support axis of rotation 21 is used as a basis. The various alignments of the segment heads 24 corresponding to the positions 22.1, 22.2 can be seen best in the three-dimensional view shown in FIG. 3. The folded-in supporting segments 22 of the drive-side sheet supports 18 point toward the operating-side sheet support 19, and the folded-in supporting segments 22 of the operating-side sheet support 19 point toward the drive-side sheet support 18. All the supporting segments 22 of the respective sheet support 18 or 19 which are to be folded in are therefore folded in one and the same direction, namely into the interior of the machine, so that, even following the deactivation of some of its supporting segments 22, the respective sheet support 18 or 19 is still very narrow and compact and can be displaced outward to a particularly great extent along the sheet support axis of rotation 21 and close to the respective chain wheel 13.

Figure 4:
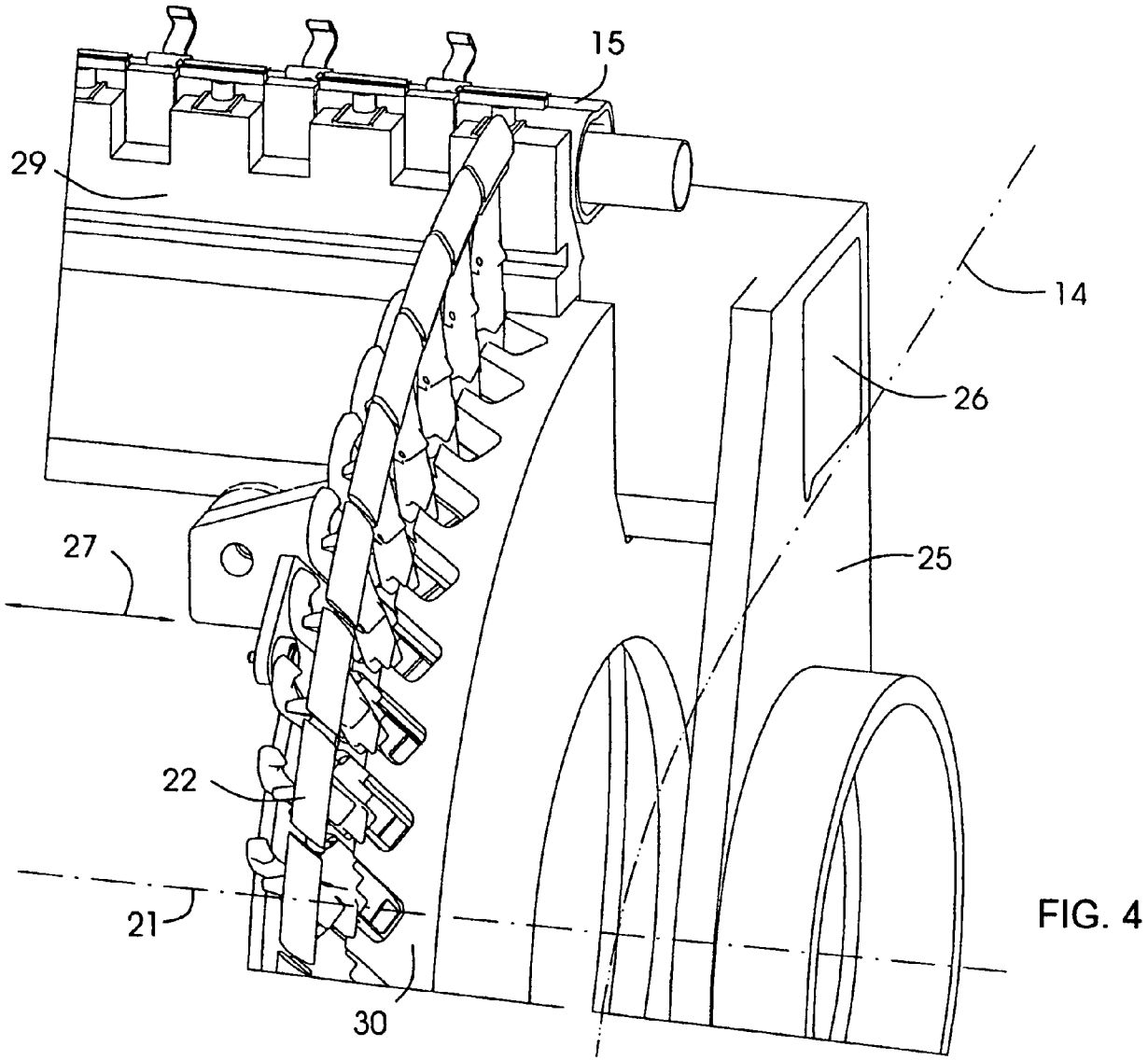
FIG. 4 is a detail, perspective view of the sheet support and a trailing gripper bar of the sheet deliverer.

In FIG. 4, an example of the drive-side sheet support 18 illustrates the fact that the sheet supports 18, 19 are mounted in a drum frame 25 having transverse guide rails 26. The guide rails 26 are aligned parallel to the sheet support axis of rotation 21. During the format change of the sheet supports 18, 19, which depends on the sheet width and is indicated by an arrow 27 in FIG. 4, rollers 28 fixed to the sheet supports 18, 19 (see FIG. 2A) run on the guide rails 26. The delivery drum 20 has a sucker bar 29 for holding the trailing sheet ends 16 firmly by vacuum. The sucker bar 29 picks up the trailing sheet end 16 of the respective sheet 2 from the impression cylinder 4 in order that, thereafter, the trailing gripper bar 15 of the second chain conveyor 7 can reliably grip the trailing sheet end 16.

Figure 5:
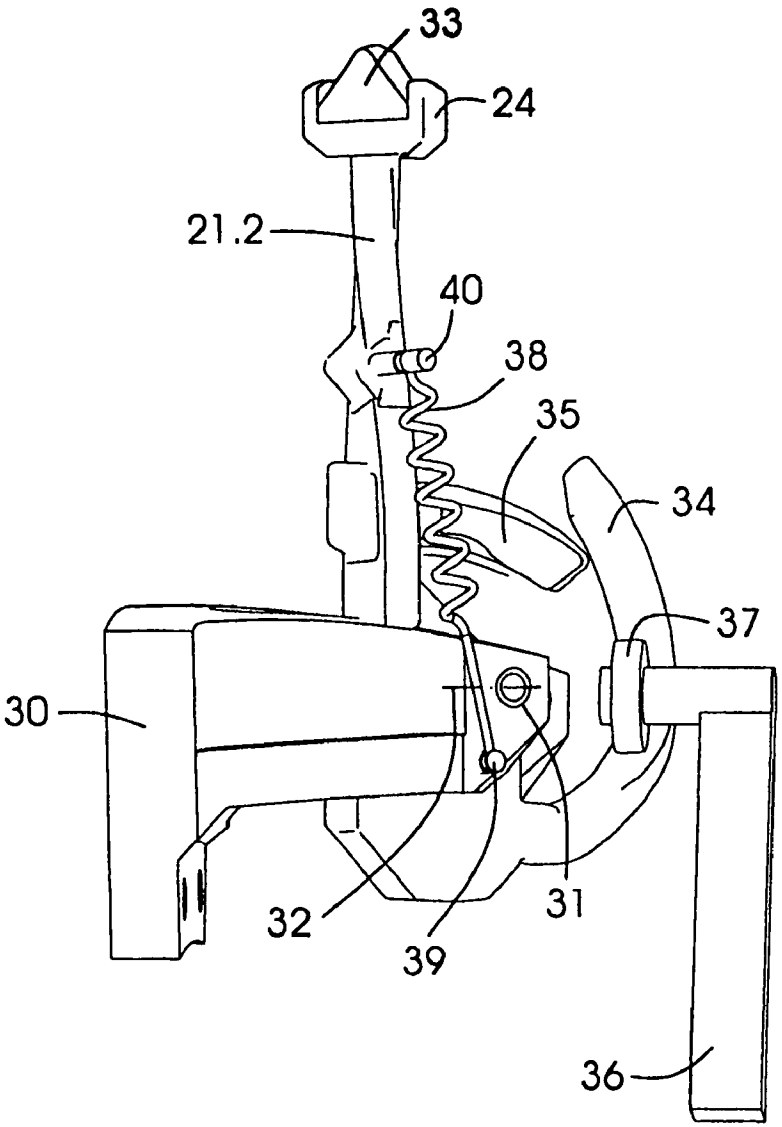
FIGS. 5 to 7 are perspective views showing the functioning of a tilting spring mechanism containing a supporting segment of the sheet support, by using a sequence of positions.

The sheet support 18 contains a carrier disk 30, in which the supporting segments 22 are mounted such that they can optionally be pivoted into the passive position 22.1 and the active position 22.2 about rotary joints 31 (see FIG. 2A and rigs. 5 to 7). Each rotary joint 31 determines a pivot axis 32 of the respective supporting segment 22, as shown in FIG. 5 using the example of a supporting segment 22 illustrated therein as a detail. With regard to a compact configuration of the sheet supports 18, 19, and at the same time lining up the supporting segments 22 very densely in a row in their active position 22.2, it is particularly advantageous that the pivot axes 32 are disposed to be skewed relative to the sheet support axis of rotation 21, where skewed axes are axes that do not have a joint spatial plane in which both axes extend. The pivot axes 32 are therefore aligned neither parallel to the sheet support axis of rotation 21 nor perpendicular to the latter. Lining up densely in a row is in turn advantageous with regard to the sheet supports 18, 19 rolling on the sheet 2 without any marking and without chattering. FIG. 5 further shows that the segment head 24 is fitted with a resilient pressure pad 33 that has a substantially triangularly tapered, pointed profile. The pressure pads 33 of the respective sheet supports 18 and 19 make contact with the sheet 2 so to speak along a track line running in the circumferential direction as they press the sheet 2 onto the impression cylinder 4.

The support segments 22 are folded in and out by a cam mechanism, which will be described in detail in the following text. Each supporting segment 22 has a first cam 34 and a second cam 35. The supporting segment 22 and the cams 34, 35 are fabricated from one and the same piece, for example as a casting. A control lever 36 having a cam roller 37 is mounted in the sheet support 18 such that it can pivot about the sheet support axis of rotation 21. The first cam 34 is substantially hook-like and begins at the end of the supporting segment 22 opposite to the segment head 24 and runs substantially in a curve to the segment head 24. The second cam 35 is substantially finger-like and disposed between the segment head 24 and the first cam 34. As a result of pivoting the control lever 36 in a clockwise direction along the supporting segments 22, the control lever 36 and its cam roller 37 come into switching contact with one after the other of the first cams 34, so that the supporting segments 22 are folded in one after another. As a result of pivoting the control lever 36 in the counterclockwise direction, the control lever 36 and its cam roller 37 come into switching contact with the second cams 35 one after another, so that one after another of the supporting segments 22 are folded out again. The first cams 34 are therefore folding-in cams or stops and are used to displace the supporting segments 22 from the active position 22.2 into the passive position 22.1. On the other hand, the second cams 35, which are folding-out cams or stops, are used for the substantially radial erection of the supporting segments 22. By the configuration of the two cams 34, 35 of the respective supporting segments 22 offset in relation to each other in the pivoting direction of the control lever, one and the same actuating element, namely the control lever 36, can advantageously be used to fold the supporting segments 22 both in and out.

Figure 6:
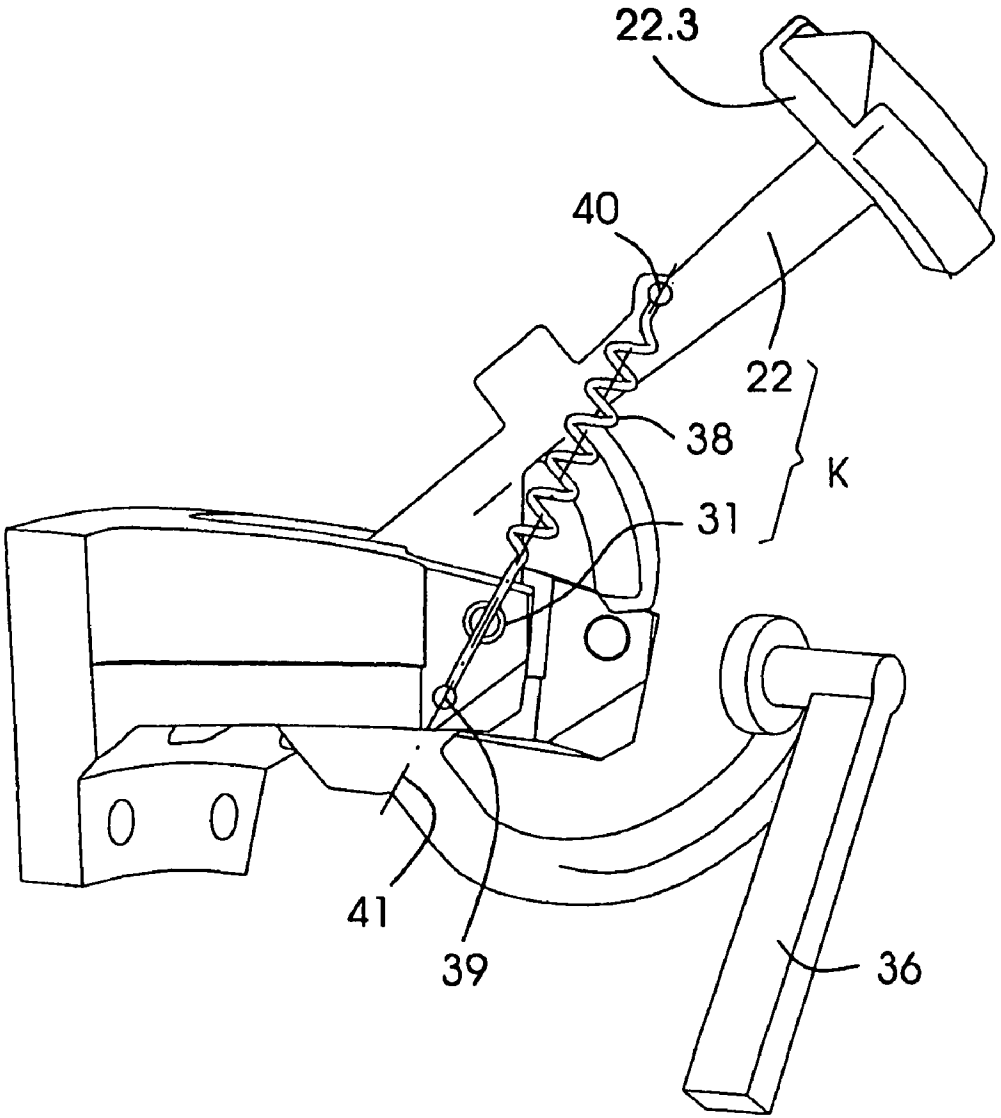
Figure 7:
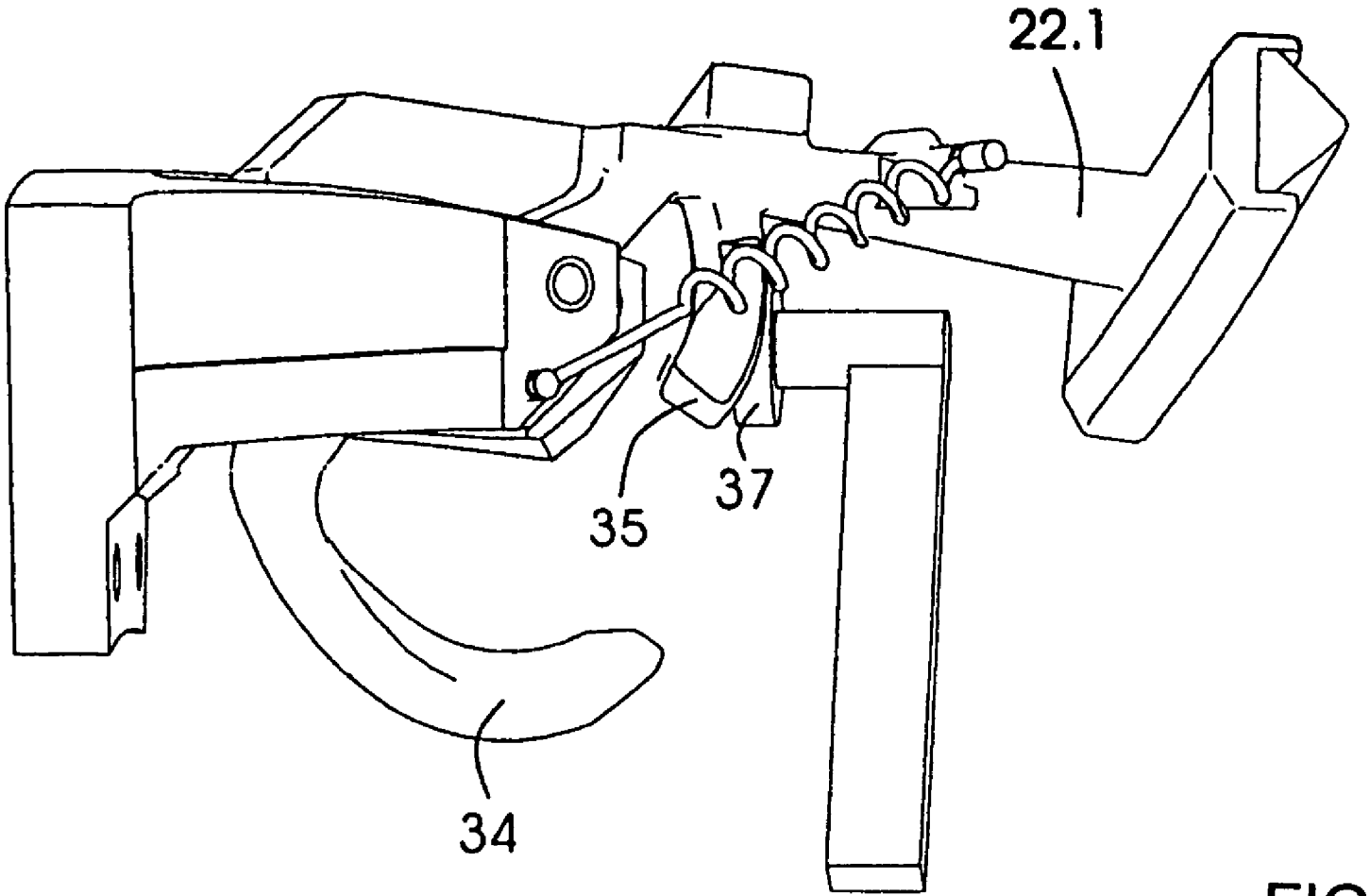

Each supporting segment 22, together with its rotary joint 31 and a spring 38, forms a bistable tilting spring mechanism (over-center device) K. The spring 38 is a tension spring and is fixed by its one spring end to the carrier disk 30 at a first fixing point 39 and by its other spring end to the supporting segment 22 at a second fixing point 40. The fixing points 39, 42 are retaining pins for hooking spring eyes of the spring 38. The spring 38 is kept permanently under prestress and, as shown in FIG. 6, has a spring force characteristic 41 on which the fixing points 39, 40 lie. FIGS. 5 and 7 show the two stable positions of the tilting spring mechanism K, specifically FIG. 5 shows the aforesaid active position 22.2 and FIG. 7 the aforesaid passive position 22.1. FIG. 6 shows an indifferent dead position 22.3 of the tilting spring mechanism K and of its supporting segment 22 located between the two stable positions. In this dead position 22.3, the spring force characteristic 41 runs through the rotary joint 31 and its pivot axis 32 and the tension of the spring 38 is at a maximum and thus greater than in the active position 22.2 and than in the passive position 22.1. The tilting spring mechanism K is also advantageous with regard to the compactness of the respective sheet support, for the following reasons. The contact paths which the cam roller 37 has to trace on the cams 34, 35 in order to effect the changeover (folding in or folding out) of the supporting segment 22 can be kept short. The cams 34, 35 therefore need to have only a short length. The duration of action of the spring force characteristic 41 changes when the latter passes the rotary joint 31 in the course of folding over the supporting segment 22. For example, the control lever 36 with its cam roller 37 needs to move along the first cam 34 during the displacement of the supporting segment 22 from the active position 22.2 (see FIG. 5) into the passive position 22.1 (see FIG. 7) only until the spring force characteristic 41 has just passed the rotary joint 31 during its change of sides relative to the latter and therefore the supporting segment 22 has passed over its dead position 22.3. After that, maintaining the contact between the first cam 34 and the control lever 36 is no longer necessary and the supporting segment 22 is pulled into the passive position 22.1 only by the spring 38 on its own; the supporting segment 22 springs automatically into the selected stable position. As the supporting segment 22 is folded out, the latter snaps into the active position 22.2 when it passes over the dead position 22.3, because of the spring loading of the supporting segment 22. After the contact previously existing between the control lever 36 and the second cam 35 has been broken, the supporting segment 22 automatically springs into the active position 22.2, because of the spring loading of the supporting segment. It can be seen in FIG. 5 that, when the supporting segment 22 is in the active position 22.2, the second cam 35 is located radially with respect to the drum above the imaginary flight circle described by the cam roller 37 about the sheet support axis of rotation 21 during the pivoting of the control lever 36. In this case, the first cam 34, as the stop for the cam roller 37, is located at the height of the flight circle. By contrast, it can be seen in FIG. 7 that, when the supporting segment 22 is in the passive position 22.1, the first curve 34 is located radially with respect to the drum underneath the aforesaid flight circle, and the second cam 35 lies on the flight circle and forms a stop for the cam roller 37 in the process. For reasons of improved clarity, the springs 38 of the tilting spring mechanisms K are not also illustrated in FIGS. 2A to 3.

Figure 8:
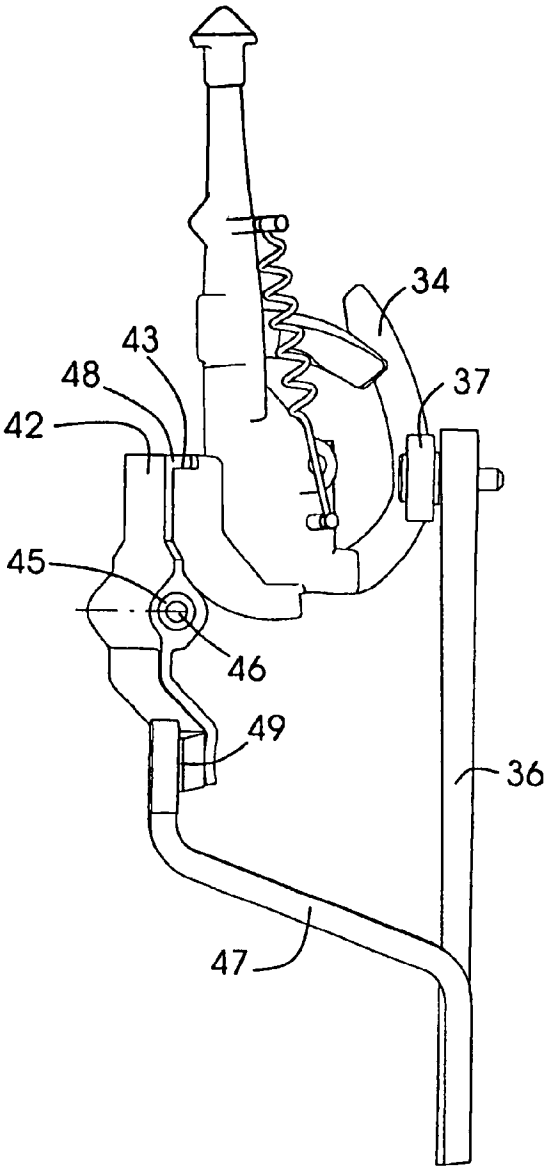
FIGS. 8 and 9 are perspective views showing the functioning of a catch assigned to the supporting segment, by using a sequence of positions.
Figure 9:
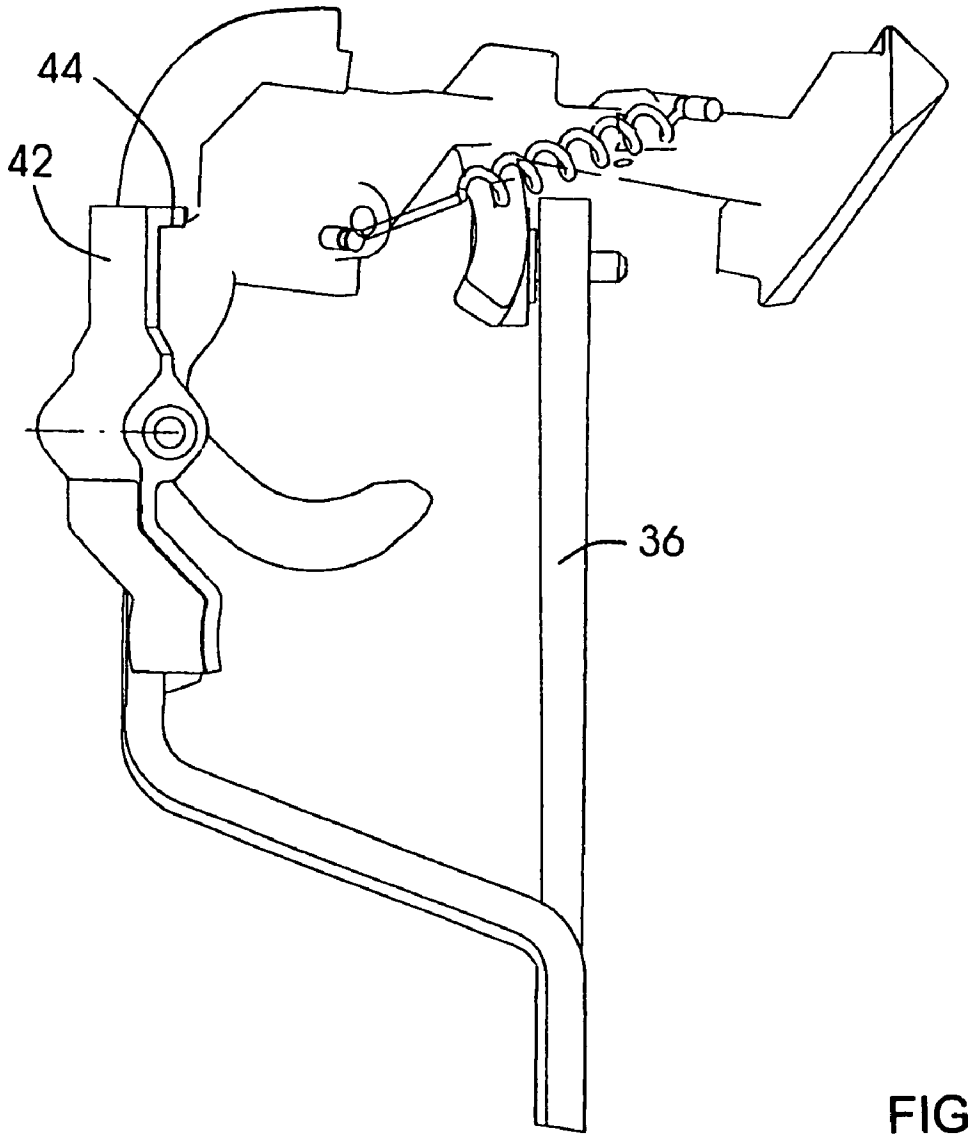

Each supporting segment 22 is equipped with a securing device which prevents inadvertently folding of the respective supporting segment 22 in and out. The securing devices are formed as safety catches and hold the supporting segment 22 firmly both in the active position 22.2 and in the passive position 22.1. Each safety catch contains a two-armed locking catch 42 which, by a locking hook 48, locks the respective supporting segment 22 in the active position 22.2 on a first detent surface 43 of the supporting segment 22, as shown in FIG. 8, and in the passive position 22.1 on a second detent surface 44, as shown in FIG. 9. Each locking catch 42 is sprung by a spring 45 that holds the locking catch 42 in the locked position. The spring 45 is a spring clip seated on a hinge journal of the locking catch 42. All the locking catches 42 of the respective row of supporting segments are unlocked one after another and counter to the actions of the springs 45 by one and the same actuating element as the supporting elements 22 are folded in. The actuating element is the control lever 36, already mentioned, which, in a multi-part and fork-like shape, apart from its lever arm carrying the cam roller 37, has a lever arm 47 provided with an inclined face 49 and, with the latter, actuating the locking catch 42 on its ratchet arm opposite the locking hook 48. The lever arm 47 is pivoted about the sheet support axis of rotation 21, so that it strikes the locking catches 42 one after another and, shortly before the cam roller 37 begins to press against the first cam 34, pivots the respective locking catch 42 out of locking engagement, counter to the restoring action of the spring 45. After the lever arm 47 has passed the locking catch 42 and the supporting element 22 has been displaced into the passive position 22.1, initially by the pressure exerted on the first cam 34 by the cam roller 37 and thereafter by the tensile force of the spring 38 of the tilting spring mechanism K, the locking catch 42 latches or snaps automatically into the second detent surface 44 or into the supporting segment 22 again, as a result of the restoring force of its spring 45. For reasons of improved clarity, the locking catches 42 and the lever 47 are not also illustrated in FIGS. 5 to 7.

Figure 10C:
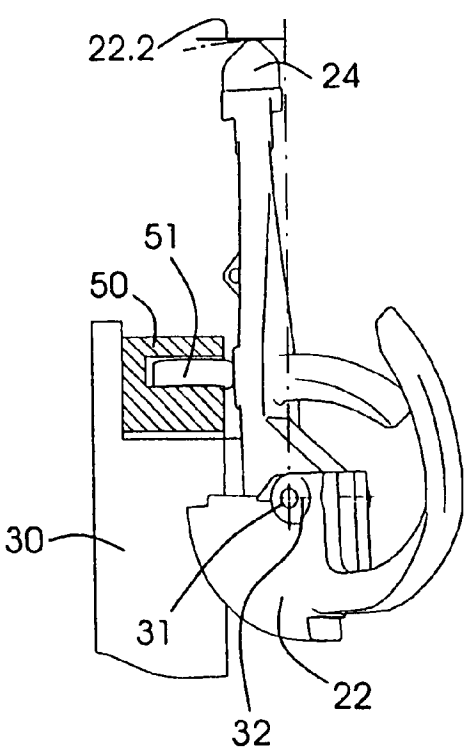
FIGS. 10A to 11C are perspective views showing the functioning of a throwing-on and throwing-off device of the sheet support, by using a sequence of positions.
Figure 10A:
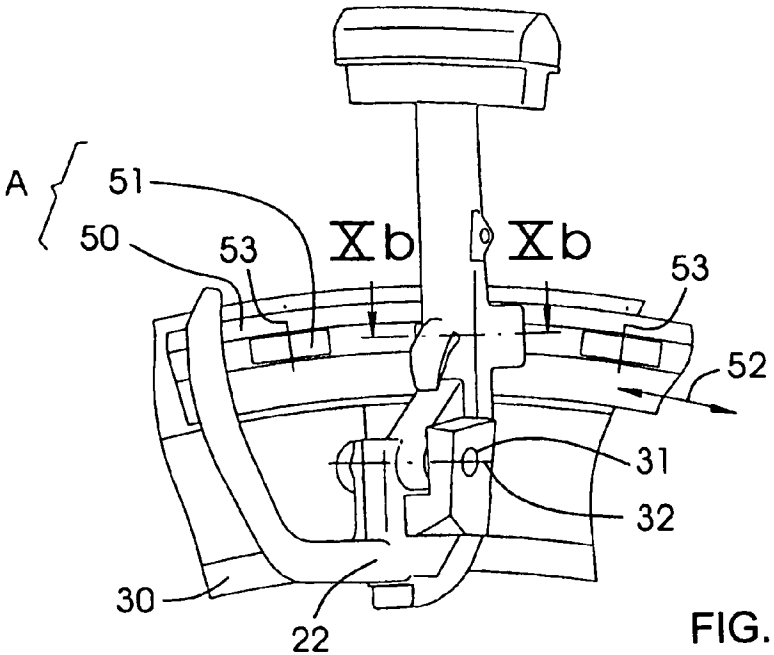
Figure 10B:
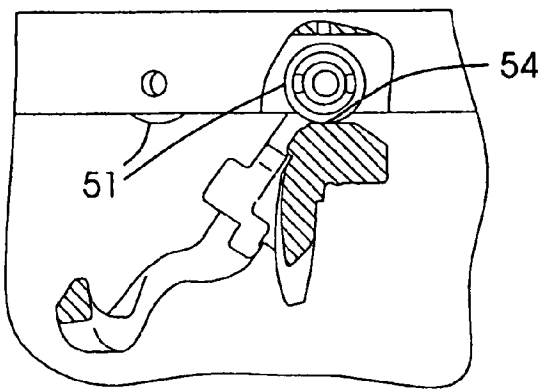
Figure 11C:
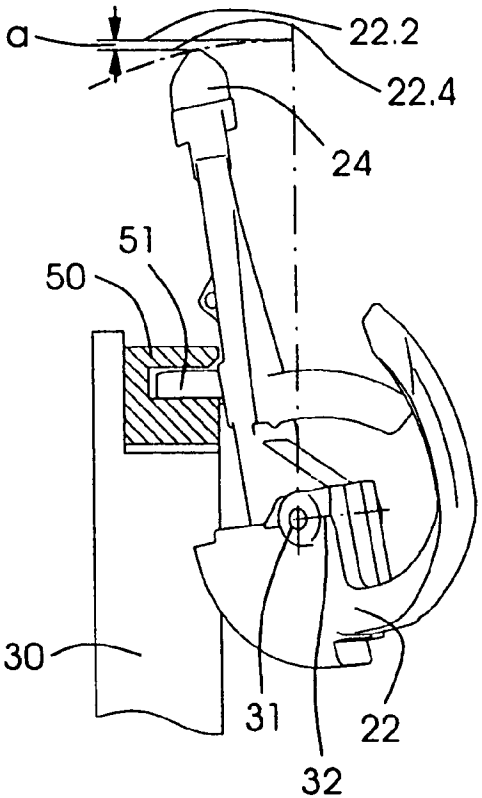
Figure 11A:
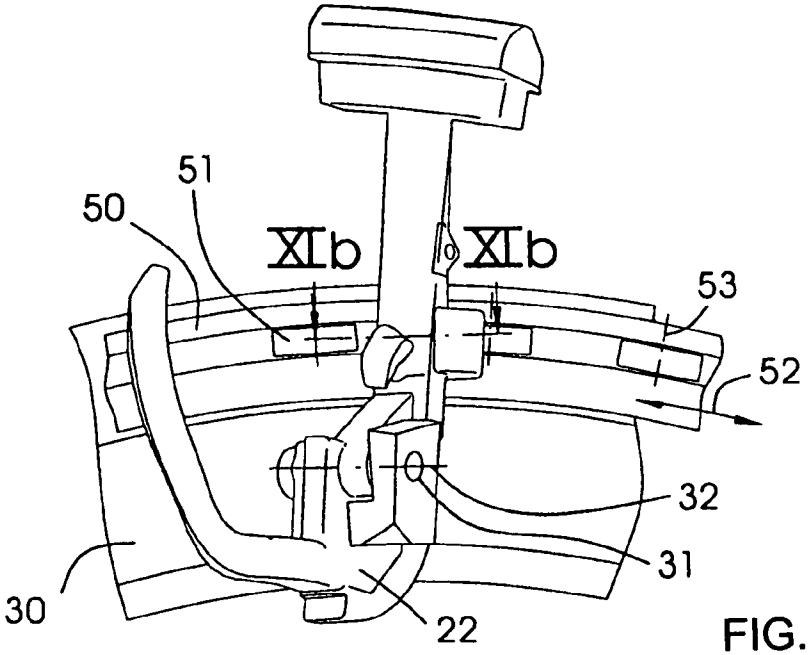
Figure 11B:
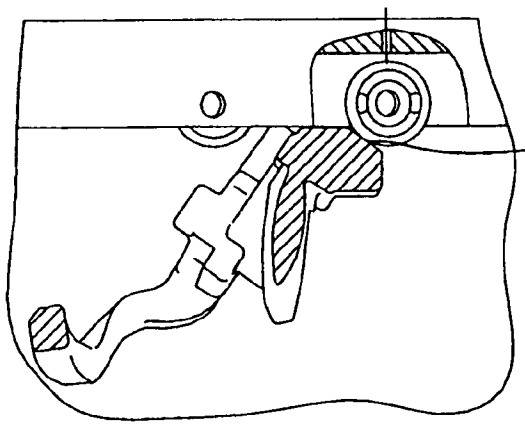

FIGS. 10A to 10C show a throwing-on and throwing-off device A for optionally throwing the supporting segments 22 onto and off the impression cylinder 4. As a central actuating element, the throwing-on and throwing-off device A contains a control ring 50 having control rollers 51, each of which displaces another of the supporting segments 22 from the active position 22.2, in which the supporting segment 22 is thrown onto the impression cylinder 4 or the sheet 2 conveyed on the latter, into a thrown-off position 22.4, in which the supporting segment 22 is out of rolling contact with the sheet 2 on the impression cylinder 4, and back. If the supporting segments 22 have been displaced into the thrown-off position 22.4 by the control ring 50, the segments 22 lie closer to the sheet supporting axis of rotation 21 by a radial distance a amounting to a few millimeters than in the active position 22.2. As viewed radially, the active position 22.2 lies between the thrown-off position 22.4 and the passive position 22.1 and closer to the former than to the latter. As a result of the displacement of the supporting segments 22 into the thrown-off position 22.4, a drum-cylinder gap formed at the tangential point 23 of the delivery drum 20 together with the impression cylinder 4 is opened. The control ring 50 is mounted substantially coaxially with the sheet support axis of rotation 21 and in the carrier disk such that it can rotate in the latter. The rotary movement of the control ring 50 about the sheet support axis of rotation 21 and, depending on the direction of rotation, used to throw the supporting segments 22 onto or off the impression cylinder 4, is indicated by an arrow 52 in FIGS. 10A and 11A. Roller axes 53 of the control rollers 51 disposed at the same distances from one another as the supporting segments 22 in the circumferential direction have radial orientations with respect to the delivery drum 20. Each supporting segment 22 has a first contact surface 54 with which it bears on the respective control roller 51 when in the active position 22.2, as shown in FIG. 10B, and a second contact surface 55, with which the supporting segment 22 bears on the control roller 51 when in the thrown-off position 22.4, as the latter is shown in FIG. 11B. The spring 38 (see FIG. 5) of the tilting spring mechanism K holds the respective contact surface 54, 55 in contact with the control roller 51 in both positions (active position 22.2, thrown-off position 22.4). The second contact surface 55 forms an inclined face running at an angle relative to the control ring 50 and, together with the first contact surface 54, forms a cam track for the control roller 51. Rotation of the control ring 50 in the counterclockwise direction from its rotational angle position shown in FIG. 10A results in the second contact surfaces 55 coming to lie opposite the control rollers 51 and the springs 38 of the tilting spring mechanisms K being able to pivot the supporting segments 22 out of the active position 22.2 into the thrown-off position 22.4. Rotating the control ring 50 back in a clockwise direction results in the control rollers 51 running up on the second contact surfaces 55 as far as the first contact surfaces 54 and coming to lie opposite the latter again, so that the supporting segments 22 are pivoted out of the thrown-off position 22.4 into the active position 22.2 by the contact surfaces 54, 55, counter to the action of the spring 38, and are held in the latter position.

This application claims the priority, under 35 U.S.C. § 119, of German patent application No. 10 2004 009 703.8, filed Feb. 27, 2004; the entire disclosure of the prior application is herewith incorporated by reference.

We claim:

1. A machine for processing sheets of printing material, comprising:

a cylinder for transporting the sheets; and sheet supports rotatably mounted about a sheet support axis of rotation and in each case have supporting segments for pressing the sheets onto said cylinder, said supporting segments mounted such that said supporting segments can be pivoted as desired into an active position and into a passive position about pivot axes, said pivot axes skewed relative to the sheet support axis of rotation.

2. The machine according to claim 1, wherein said supporting segments have segment heads, and in the passive position said segment heads of said supporting segments form an overlapping formation.

3. The machine according to claim 1, further comprising bistable tilting spring mechanisms and said supporting segments belong to said bistable tilting spring mechanisms, and each of which have an indifferent dead position.

4. The machine according to claim 3, wherein said bistable tilting spring mechanisms in each case have a spring with a spring force characteristic which, in the indifferent dead position, runs through a respective one of the pivot axes.

5. The machine according to claim 1, further comprising locking catches for locking said supporting segments in the passive position.

6. The machine according to claim 5, further comprising a lever arm pivotable relative to said locking catches, and said locking catches are lined up in a row such that said lever arm, in a course of its pivoting movement, strikes said locking catches one after another for actuating them.

7. The machine according to according to claim 1, further comprising a control lever being pivotable relative to said supporting segments; and wherein said supporting segments each have a first stop and a second stop, said first and second stops are disposed to be offset from one another in such a way that said control lever that can be pivoted relative to said supporting segments strikes said first stop in order to fold a respective one of said supporting segments in and strikes said second stop in order to fold said respective supporting segment out.

8. The machine according to claim 7, wherein said first and second stops are cams.

9. The machine according to claim 1, further comprising a throwing-on and a throwing-off device for pivoting said supporting segments respectively in one pivoting direction and, in a process, into a thrown-off position, the active position being formed before the passive position in a pivoting direction and the thrown-off position being formed thereafter.

10. The machine according to claim 9, wherein said throwing-on and throwing-off device contains a control ring that can be rotated relative to said supporting segments and is mounted substantially coaxially with the sheet support axis of rotation.

11. The machine according to claim 1, further comprising a deliverer having a delivery drum for delivering the sheets, said sheet supports are constituent parts of said delivery drum.

12. The machine according to claim 11, wherein said deliverer contains leading gripper bars for firmly holding leading sheet ends of the sheets, and trailing gripper bars for simultaneously firmly holding trailing sheet ends of the sheets.

* * * * *